United States Patent [19]

Yanagimoto et al.

[11] Patent Number: 4,930,566

[45] Date of Patent: Jun. 5, 1990

[54] METHOD FOR CONTINUOUS CASTING OF AN ALUMINUM-LITHIUM ALLOY

[75] Inventors: Shigeru Yanagimoto, Fukushima; Ryoichi Kondo, Kanagawa, both of Japan

[73] Assignee: Showa Denko Kabushiki Kaisha, Tokyo, Japan

[21] Appl. No.: 411,126

[22] Filed: Sep. 22, 1989

[30] Foreign Application Priority Data

Sep. 24, 1988 [JP] Japan ..... 63-239541

[51] Int. Cl.[5] ..... B22D 11/12; B22D 11/16

[52] U.S. Cl. ..... 164/475; 164/472; 164/490

[58] Field of Search ..... 164/486, 475, 472, 490

[56] References Cited

U.S. PATENT DOCUMENTS 4,157,728 6/1979 Mitamura et al. ..... 164/4
4,200,138 4/1980 Hildebrandt ..... 164/475
4,567,936 2/1986 Binczewski ..... 164/453
4,610,295 9/1986 Jacoby et al. ..... 164/5
4,651,804 3/1987 Grimes et al. ..... 164/455

FOREIGN PATENT DOCUMENTS 60-250860 12/1985 Japan .
62-220248 9/1987 Japan ..... 164/486

*Primary Examiner*—Richard K. Seidel
*Assistant Examiner*—Rex E. Pelto
*Attorney, Agent, or Firm*—Armstrong, Nikaido, Marmelstein, Kubovcik & Murray

[57] ABSTRACT

In a method for continuous casting of an aluminum-lithium alloy through an open-ended mold for forming an ingot, wherein gas under pressure is brought into contact with a molten surface part of said ingot directly before solidification, the gas used consists of from 1 to 15 volume % of oxygen and balance of inert gas. The casting is stabilized and cast skin is improved by the use of said gas.

7 Claims, 3 Drawing Sheets

METHOD FOR CONTINUOUS CASTING OF AN ALUMINUM-LITHIUM ALLOY

BACKGROUND OF THE INVENTION

1. Field of the Invention

The present invention relates to a method for horizontal or vertical continuous casting of an aluminum-lithium based alloy, and, more particularly to an improved contacting method of the molten metal with gas. The contacting method mentioned above particularly relates to the gas-pressure application method in hot-top casting.

2. Description of Related Arts

The aluminum-lithium based alloy exhibits a low density, high strength and elasticity, and excellent fracture toughness. This alloy is therefore presently used mainly for construct-ional materials of air crafts. Active development has also been made which discovered a composition of the aluminum-lithium alloy having high strength per weight.

Usually, an aluminum-lithium based alloy is continuously cast to form a sheet, slab or billet, and is then rolled to form a rolled sheet or is extruded to form extruded profiles. The rolled sheet or extruded profiles may further be subjected to plastic working.

The continuous casting is carried out mainly by the direct chill method. Since the qualities of the continuously cast ingot have been recently enhanced, the rolling and extruding steps can be omitted. In order to reduce the cost, it is desirable to produce an ingot having a small cross section by continuous casting, and to use such ingot directly as a product, or subject it to rolling.

The aluminum-lithium alloy is active and is hence usually molten and then cast in an inert atmosphere. Particularly, when the lithium content of the alloy is high, the molten metal of aluminum-lithium alloy is caused to react vigorously with water which is usually used as the cooling medium in the casting operation. Since the danger of explosion is involved, strict caution should be taken to avoid explosion.

Japanese Unexamined Patent Publication No. 60-250860 proposes a method to exclude the contact of the surface of molten metal with air so as to avoid explosions. According to the proposal, the space above the level of molten metal in the mold, into which the molten metal is introduced, is closed, and this space is filled with inert gas. The inert gas prevents an oxide film from forming on the active surface of the molten metal and hence leads to the production of an excellent, continuously cast ingot.

Japanese Unexamined Patent Publication No. 60-127059 proposes using, as the cooling medium in the casting operation, an organic cooling medium which contains in particular 75% or more of ethylene glycol. In the proposed method it is intended that even when the so-called break out, i.e., flowing of molten metal through the solidified shell, occurs during casting, direct contact of the molten metal with water, which would result in a strong explosion, would be prevented.

In Japanese Unexamined Patent Publication No. 60-180656 which is related to a vertical direct chill semi-continuous casting, the cooling water is continuously pumped from the pit of a casting machine so as to avoid the stagnation of water in the pit, and hence a strong explosion due to the contact of the molten metal of aluminum-lithium alloy with water.

Japanese Unexamined Patent Publication No. 62-104652 discloses a clad casting method, in which an ingot comprising an outer shell made of a lithium-free aluminum alloy, and a core made of lithium-containing aluminum alloy is continuously cast. Allegedly, the aluminum-lithium alloy is essentially prevented from contact with the cooling water in the DC (direct chill) casting operation, thereby avoiding the explosive reaction between water and lithium.

U.S. Pat. No. 4,157,728 (Japanese Examined Patent Publication No. 54-42847) discloses an improved DC casting method by means of applying gas pressure to the molten metal being cast.

Japanese Unexamined Patent Publication No. 61-71157 discloses the elimination, in the horizontal continuous casting, of the unbalanced cooling of molten metal in a mold and non-uniformity of the lubricating surface on the inner wall of a mold, thereby homogenizing the cast structure, eliminating the cast defect and break out, and hence constantly casting ingots of good quality. The method proposed in the above-mentioned publication is such that gas is introduced into a corner which is formed by a tubular mold and a protruding part of a refractory plate which is provided with an aperture for introducing the molten metal into the tubular mold. The protruding part of the refractory plate protrudes toward the inner wall of the tubular mold and forms, together with said inner wall, the above mentioned corner below the axial line of the tubular mold. The gas introduced into the corner forms a space where the gas pressure is applied. The gas pressure applied causes such a deviation of the contact position of the molten metal with the inner wall of tubular mold that it shifts horizontally toward the downstream side. Such deviation results in controlling the cooling of the molten metal at contact position mentioned above.

According to the above described method for filling the closed space with the inert gas above the level of molten metal, the contact of molten metal with air can be prevented in order to suppress the formation of oxide. However, a large amount of lubricating agent is necessary, and, even if a large amount of lubricating oil is supplied, rough cast skin is formed during a long period of operation which makes the casting operation instable.

According to the method for using the cooling agent which mainly consists of ethylene glycol and prevents explosion upon break out, the casting plant needs to be fundamentally re-adjusted and control of the operating conditions become very complicated. Cast skin does not appear to be improved by the above mentioned method.

The method for constantly draining the cooling water in the pit is undoubtedly an appropriate safety countermeasure to avoid danger in the case of break out. However, the casting plant needs to be reconstructed and the operating conditions need to be strictly controlled.

The clad casting method is complicated and the casting conditions need to be strictly controlled. In addition, the outer shell must be peeled later.

The present inventors applied the gas-pressure application method disclosed in U.S. Pat. No. 4,157,728 to aluminum-lithium alloy. They used not only air but also such inert gases as argon and nitrogen for the pressure-application. However, the molten metal stuck on the mold wall to form the sticking skin. It was therefore confirmed that the gas pressure application method is not as effective for the aluminum-lithium alloy as it is for aluminum and its lithium-free alloys.

The present inventors also carried out the horizontal continuous casting method of aluminum-lithium alloy under the application of gas pressure. The sticking of the cast skin was also drastic. In addition, open cracks were formed on the cast skin in a circumferential direction around the ingot. The open cracks resulted in not only cast defects but also operation troubles due to the flowing of molten metal through them.

SUMMARY OF THE INVENTION

It is an object of the present invention to provide a continuous casting method for aluminum-lithium alloy, in which the above described drawbacks are eliminated, and, particularly both stability in casting and improvement in cast skin are attained.

In accordance with the present invention, the stability in casting and improvement in cast skin are attained by bringing the surface of the molten metal directly before solidification with the gas which contains from 1 to 15% by volume of oxygen. In the casting methods for bringing gas into contact with the molten metal directly before solidification, the gas according to the present invention can be used. Casting methods, to which the inventive method can be applied, are not limited to the DC casting method, but can be applied to any casting method, in which relative speed is generated between an ingot and a movable or stationary mold. In the casting method, it is necessary in the casting methods that the molten metal direction before the solidification, an inner wall of the mold, and another member of a casting apparatus form a space where the gas under pressure is present and apply pressure to the molten metal directly before solidification. The molten metal directly before solidification indicates herein not only a part of the molten metal of aluminum-lithium alloy which is in a vicinity of the solid-liquid interface, but also broadly indicates a part of the molten metal which is poured in the mold and which exerts an influence on the casting stability and quality of the cast skin.

Example of the casting methods, to which the present invention is applied, are as follows.

A. Hot-top method under the application of gas pressure disclosed in U.S. Pat. No. 4,157,728.

The application of the present invention to this method is described hereinbelow with reference to FIG. 1.

B. Continuous casting method disclosed in U.S. Pat. No. 4,598,763.

Gas and lubricating oil are supplied through a gas-permeable graphite ring to the surface of the molten metal. When the present invention is applied to this method, the inventive, oxygen-containing gas is fed through the gas-permeable ring and applies pressure onto the circumferential surface of the molten metal.

C. Continuous casting method disclosed in U.S. Pat. No. 4,664,175. A heat-insulative sleeve is located within a mold in such a manner that a closed space is formed by the mold wall, the sleeve and the top surface of the molten metal in the mold, and pressure gas is introduced into the closed space. The pressure gas contains oxygen in an amount disclosed herein, when the inventive method is applied to the continuous casting method mentioned above.

D. A continuous casting and rolling method such as disclosed in Japanese Unexamined Patent Publication No. 60-6,251. Molten metal is fed into the clearance between a pair of cooling rolls, so as to continuously solidify the molten metal and then roll it into a sheet. The gas is introduced into the clearance which is formed by the rolls, a nozzle and the molten metal. The gas to be introduced into the clearance contains oxygen in an amount disclosed herein, when the inventive method is applied to the continuous casting method mentioned above.

E. The direct chill casting method disclosed in GB No. 2,014,487. In this method, during the casting operation, the axial length of a part of the molten metal in contact with a mold is varied independently of variations of the quantity of the molten metal in the mold. The emergent portion of an ingot is supported laterally by an annular cushion of gas which is applied through a porous diaphragm extending around the ingot. The inventive gas can be used for applying the annular cushion of gas.

In the above mentioned method, a rigid thermally insulating sleeve is partially within and in clearance of the inner surface of an upper part of the mold. An upper part of the annular gap between the sleeve and mold is sealed. The gas pressure is applied to the upper end of the gap to vary the axial length of the molten metal's contact part with the mold. The inventive gas can be used for applying the gas pressure to the above mentioned upper part.

F. The horizontal continuous casting method disclosed in U.S. Pat. No. 4,653,571. The application of the present invention to this method is described with reference to FIG. 2.

G. The method for continuous casting disclosed in Japanese Unexamined Patent Publication No. 49-29,226. The application of the present invention to this method is described with reference to FIG. 3.

The embodiments of the present invention are hereinafter described with reference to the drawings.

DESCRIPTION OF PREFERRED EMBODIMENTS

Figure 1:
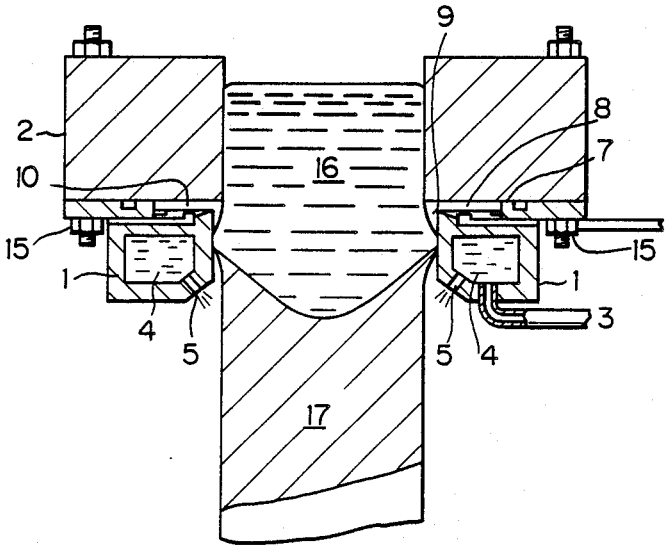
FIG. 1 is a cross sectional view of the hot-top casting apparatus under the application of gas pressure.

Referring to FIG. 1, an embodiment of the hot-top casting method carried out under the application of gas pressure is illustrated.

Lubricating oil is fed from the clearance 8 through the annular passage for the lubricating oil 10 onto the inner wall of a mold. Gas for pressure application is introduced through the annular passage of gas 7 and is then ejected toward the surface of the molten metal via a minute clearance which is formed at the contact plane between the reservoir of molten metal 2 and the top surface of mold 1. The introduced gas forms a space in the corner which is formed by the reservoir of molten metal 2 and the inner wall of mold 1. The gas in this space applies pressure to the molten metal, the contact point of which metal with the mold 1 is then displaced downward.

Figure 2:
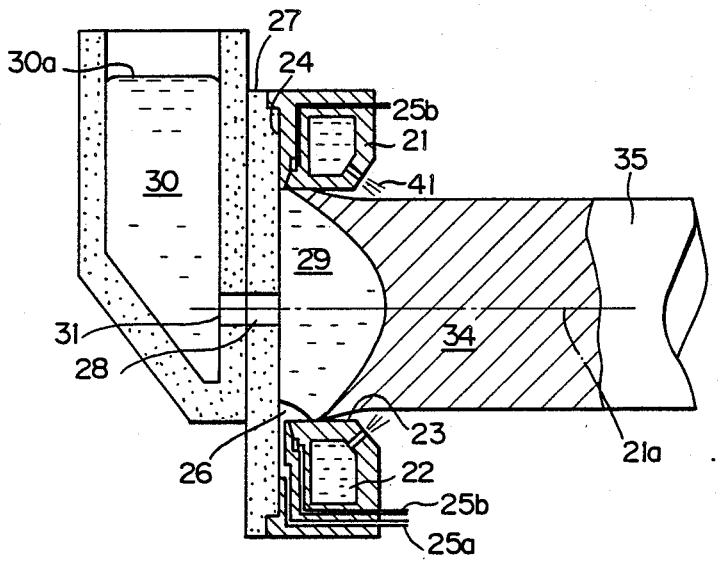
FIG. 2 is a cross sectional view of the horizontal casting apparatus under the application of gas pressure.

Referring to FIG. 2, an embodiment of the horizontal casting method carried out under the application of gas pressure is illustrated. Lubricating oil is fed through an oil-feeding conduit 25b to the inner wall of a mold 21. Gas is fed through the gas-introducing conduit 25a into the mold 21, with the result that a space 26, where the gas-pressure is applied, is formed. The gas in this space 26 applies pressure to the molten metal, the contact point of which metal with the mold 21 is then displaced to a down stream position.

When the gas for pressure application used in the casting methods as described with reference to FIGS. 1 and 2 contained a small amount of oxygen, unexpectedly, the casting was stabilized, and the cast skin was outstandingly improved.

The aluminum-lithium alloy, which is subjected to the method of the present application, contains approximately 0.5% or more, particularly from 0.5% to 5% of lithium, and may further contain a principal alloying element(s) added for improving the mechanical properties, such as magnesium, copper, zinc, zirconium, and the like.

The oxygen concentration of gas for the pressure application is from 1 to 15% by volume. The part other than oxygen is an inert and incombustible gas, such as nitrogen, argon, carbon dioxide, or helium, or a mixed gas of these. The inert and incombustible gas may be added to air to adjust its oxygen concentration. When the oxygen content exceeds 15% by volume, the aluminum-lithium alloy is so vigorously oxidized as to make the casting impossible. On the other hand, when the oxygen content is less than 1% by volume, the oxygen is very diluted so that the casting becomes unstable, and, further, the cast skin is not appreciably superior to that obtained by using the inert gas alone.

When gas pressure is applied only by means of the inert gas, no oxide film is present on the surface of molten metal exposed in the mold and facing the inner wall of a mold: that is, the molten metal itself faces the inner wall of the mold.

In this case, sticking is very liable to occur. Feeding a large amount of lubricating oil can prevent sticking for the aluminum and its lithium-free alloys, but not for the aluminum-lithium alloy. On the contrary, when the gas pressure is applied by means of the inventive, oxygen-containing gas, an oxide film seems to form on the surface of the molten metal exposed in the mold and facing the inner wall of the mold and to play the role of preventing the sticking of molten metal with the mold.

Elemental lithium forms a fine powder of lithium dioxide as a result of the reaction with oxygen. The lithium dioxide powder seems also to play a role of preventing the sticking of molten metal with the mold.

Figure 3:
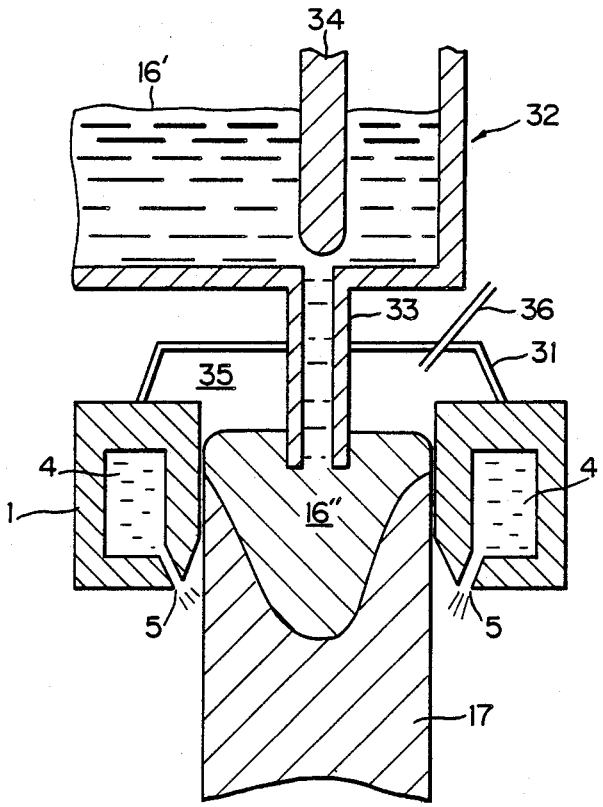
FIG. 3 is a cross sectional view of the casting apparatus equipped with a trough.

Referring to FIG. 3, a continuous casting apparatus with a trough is illustrated. The molten metal 16' is stored in the trough 32 which is provided on its bottom with a spout 33. The stopper 34 is vertically movable and located above the spout 33 so as to allow adjustment of the amount of molten metal flowing through the spout 33. The molten metal 16'' flowing into the mold 1 is subjected to DC casting. The cover 31 above the molten metal 16'' is fixed to the mold 1 and the spout 33 so as to form a closed space 35 above the level of molten metal 16''. This closed space 35 is shielded from the ambient air. The conduit 36 gas-tightly protrudes through the cover 31 and is used for feeding the inventive, mixed gas under pressure therethrough. The pressure of mixed gas is slightly higher than atmospheric pressure.

The present invention is described in more detail with reference to the drawings.

EXAMPLE 1 AND COMPARATIVE EXAMPLE 1

Casting was carried out by the hot-top continuous casting apparatus with the application of gas pressure, shown in FIG. 1, while varying the kinds of gases for the pressure application and mixing ratio of oxygen gas. The casting conditions were as follows.

(a) Alloy: AA 2090, Cu-2.7 wt %, Li-2.2 wt %, Zr-0.11 wt %, Al-Balance
(b) Diameter of billet: 100 mm
(c) Casting speed: 150 mm/min
(d) Feeding amount of cooling water: 40 l/min
(e) Kind of lubricating oil: castor oil
(f) Feeding amount of lubricating oil: 2 cc/min
(g) Casting temperature: 690° C.
(h) Feeding amount of gas: 1 l/min The results are shown in Table 1.

TABLE 1

| | Test Nos. | Composition of gas for pressure-application (oxygen content) | Castability (*1) | Cast skin | Total Evaluation (*2) |
|---|---|---|---|---|---|
| Example 1 | 1 | Argon (10%) | O | smooth | A |
| | 2 | 50% Argon + 50% Air | O | " | A |
| | 3 | Nitrogen (7%) | O | " | A |
| | 4 | Helium (12%) | O | " | A |
| | 5 | Carbon Dioxide gas (5%) | O | " | A |
| Comparative Example 1 | 6 | Air | X | — | C |
| | 7 | Argon | Δ | Seriously sticky skin | B |
| | 8 | Nitrogen | Δ | Sticky skin and Open crack | B |
| | 9 | Carbon Dioxide gas | Δ | Sticky skin | B |

Remarks
(*1) O: Virtually the same castability as that of ordinary aluminum alloys other than aluminum -lithium alloys.
Δ: Cast skin is poor. Notwithstanding various adjustment of the casting conditions, the casting could not be continued for a long time. Castings with good cast skin cannot be obtained.
X: The molten metal is burnt within a header, and, the casting is impossible.
(*2) A: Casting is easy and operation is possible.
B: Casting is extremely difficult.
C: Casting is impossible.

It is apparent from the above results that the use of a mixed, inert gas and oxygen in a small amount is very effective for stable casting operation and good cast skin in the hot-top continuous casting method with the application of gas pressure.

EXAMPLE 2

Casting was carried out by the horizontal continuous casting apparatus with the application of gas pressure, shown in FIG. 2, while varying the kinds of gases for the pressure application and the mixing ratio of oxygen gas. The casting conditions were as follows.

(a) Alloy: X2090, Cu-4.5 wt %, Li-1.1 wt %, Mn-5 wt %, Cd-0.2 wt %, Al-balance
(b) Diameter of billet: 67 mm
(c) Casting speed: 250 mm/min
(d) Feeding amount of cooling water: 20 l/min
(e) Kind of lubricating oil: castor oil
(f) Feeding amount of lubricating oil: 5 cc/min
(g) Casting temperature: 690° C.
(h) Feeding amount of gas: 0.2 l/min

COMPARATIVE EXAMPLE 2

Air and inert gas alone were used. The casting conditions are the same as in Example 2.

The results are shown in Table 2.

TABLE 2

| | Test Nos. | Composition of gas for pressure-application (oxygen content) | Castability (*1) | Cast skin | Total Evaluation (*2) |
|---|---|---|---|---|---|
| Example 2 | 10 | Nitrogen (10%) | O | smooth | A |
| | 11 | Argon + 50% Air | O | " | A |
| | 12 | Argon (6%) | O | " | A |
| | 13 | Carbon dioxide gas (13%) | O | " | A |
| | 14 | Helium (8%) | O | " | A |
| Comparative Example 2 | 15 | Air | X | — | C |
| | 16 | Argon | Δ | Seriously sticky skin, Open cracks | B |
| | 17 | Nitrogen | Δ | Sticky skin, Melt leaked sometimes | B |
| | 18 | Carbon dioxide gas | Δ | Stick skin | B |

(*1), (*2) - The same as in Table 1

It is apparent from the above results that the use of a mixed, inert gas and oxygen in a small amount is effective for stable casting operation and good cast skin in the horizontal continuous casting operation method with the application of gas pressure.

EXAMPLE 3

Casting was carried out by the horizontal continuous casting apparatus shown in FIG. 2.

An Al-3% Li alloy was continuously cast with the use of 8% oxygen-argon gas.

The casting conditions were as follows.

(a) Alloy: Al-3% Li alloy
(b) Diameter of billet: 50 mm
(c) Casting speed: 350 mm/min
(d) Feeding amount of cooling water: 20 l/min
(e) Kind of lubricating oil: castor oil
(f) Casting temperature: 690° C.
(g) Feeding amount of gas: 0.18 l/min The feeding amount of lubricating oil was varied to obtain the critical amount, because longitudinal, linear scratching flaws had been known to form due to an insufficient amount of lubricating oil. The critical feeding amount of lubricating oil is 1.3 cc/min. The casting continued for 8 hours under feeding conditions of 1.3 cc/min of the lubricating oil, without incurring any trouble.

COMPARATIVE EXAMPLE 3

The method under the same casting conditions as in Example 3 was carried out except that the argon gas, alone, was used as the gas for applying the pressure. The critical amount of lubricating oil was found to be 3.4 cc/min. When the casting continued for approximately one hour under the feeding condition of 3.4 cc/min of lubricating oil, rough skin became clearly appreciable. After two hours, defects in the form of large longitudinal lines extending in the casting direction developed, and the casting became impossible.

The above results obtained in Example 3 and Comparative Example 3 show that, by using the mixed inert gas and a small amount of oxygen as the gas for pressure application, casting is stabilized, cast skin is improved, and the feeding amount of lubricating oil is reduced.

We claim:

1. A method for continuous casting of an aluminum-lithium alloy through an open-ended mold for forming an ingot, comprising, contacting a pressurized gas with a molten surface part directly before solidication, characterized in that said pressurized gas consists of from 1 to 15 volume % of oxygen and balance of inert gas.

2. A method according to claim 1, wherein lubricating agent is fed to an inner circumferential surface of the open-ended mold, and pressure is applied to a circumferential part of the ingot, directly before the solidification.

3. A method according to claim 1, wherein said inert gas is at least one gas selected from the group consisting of nitrogen, argon, carbon dioxide, and helium.

4. A method according to claim 3, wherein the continuous casting method is a vertical casting.

5. A method according to claim 3, wherein the continuous casting method is a horizontal casting.

6. A method according to claim 1, 2, 3, 4, or 5, wherein said aluminum-lithium alloy contains 0.5% by weight or more of lithium.

7. A method according to claim 6, wherein said aluminum-lithium alloy contains from 0.5 to 5% by weight of lithium.

* * * * *